US010841689B2

(12) United States Patent
Fay et al.

(10) Patent No.: US 10,841,689 B2
(45) Date of Patent: Nov. 17, 2020

(54) LOUDSPEAKER AND TOWER CONFIGURATION

(71) Applicant: Harman International Industries, Incorporated, Stamford, CT (US)

(72) Inventors: Jeffery Fay, Novi, MI (US); Amin Einakian, Detroit, MI (US); Kristopher Bellinghausen, Whitmore Lake, MI (US); Tomas DeLuna, Livonia, MI (US); Royce D. Channey, Ann Arbor, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/590,295

(22) Filed: Oct. 1, 2019

(65) Prior Publication Data

US 2020/0107111 A1 Apr. 2, 2020

Related U.S. Application Data

(60) Provisional application No. 62/740,320, filed on Oct. 2, 2018.

(51) Int. Cl.
*H04R 1/24* (2006.01)
*H04R 1/02* (2006.01)
(Continued)

(52) U.S. Cl.
CPC ..... *H04R 1/24* (2013.01); *F21V 33/0056* (2013.01); *H04R 1/023* (2013.01); *H04R 1/025* (2013.01);
(Continued)

(58) Field of Classification Search
CPC ..... H04R 1/24; H04R 1/1016; H04R 5/02; H04R 1/028; H04R 1/1058; H04R 1/26; H04R 1/345; H04R 1/403; H04R 1/025; H04R 2201/021; H04R 27/00; H04R 1/023; H04R 1/1091; H04R 1/2811; H04R 1/2896; H04R 2499/13; H04R 29/00; H04R 31/00; H04R 7/02; H04R 1/1033; H04R 1/1041; H04R 1/1075; H04R 1/2888; H04R 2201/028; H04R 1/227; H04R 1/2834;
(Continued)

(56) References Cited

U.S. PATENT DOCUMENTS 5,784,473 A * 7/1998 Ferren ..... H04R 5/02 181/155
8,243,963 B2 * 8/2012 Gladwin ..... H04R 9/063 381/182
(Continued)

*Primary Examiner* — Lun-See Lao
(74) *Attorney, Agent, or Firm* — McCoy Russell LLP

(57) ABSTRACT

The present disclosure relates to loudspeaker systems and configurations. In one embodiment, a loudspeaker includes a housing, a mount coupled to the housing, and a coaxial speaker fixed with the housing, wherein coaxial speaker is fixed with an angular offset from a horizontal plane of the housing. The coaxial speaker may be fixed with an angular offset from a horizontal plane of the housing to project sound to position behind a marine vehicle, such as a desired rider position. The loudspeaker may also include at least one multicolor element and connections to receive audio data and lighting control signals for the multicolor element.

18 Claims, 8 Drawing Sheets

(51) Int. Cl.
*H04R 3/14* (2006.01)
*F21V 33/00* (2006.01)
*F21Y 113/10* (2016.01)

(52) U.S. Cl.
CPC ..... *H04R 1/026* (2013.01); *H04R 3/14* (2013.01); *F21Y 2113/10* (2016.08)

(58) Field of Classification Search
CPC ..... H04R 1/2865; H04R 1/323; H04R 1/34; H04R 2209/022; H04R 2440/05; H04R 2499/11; H04R 7/045; H04R 7/127; H04R 7/16; H04R 9/04; H04R 1/02; H04R 1/026; H04R 1/06; H04R 1/1008; H04R 1/20; H04R 1/22; H04R 1/2803; H04R 1/288; H04R 2201/023; H04R 2201/029; H04R 2201/107; H04R 2227/005; H04R 29/007; H04R 5/033; H04R 5/04; H04R 9/025; H04R 9/046; H04R 9/06; H04N 5/4403; H04N 2005/4428; H04N 21/42222; H04N 5/60; H04N 17/004; H04N 5/04; G10H 1/047; G10K 11/004; G10K 11/025; G10K 15/00; G10K 15/08; H04B 17/21; H04B 17/364; H04B 1/385; H04M 1/05; H04M 1/62; H04S 2400/01; H04S 2400/05; H04S 3/008; H04S 7/301; H04W 56/009
USPC ..... 381/386, 396, 389, 300, 335, 1, 412, 26; 181/148, 150, 163, 144, 191
See application file for complete search history.

(56) References Cited

U.S. PATENT DOCUMENTS

| | | | | |
|---|---|---|---|---|
| 10,136,237 | B2 * | 11/2018 | Schuijers | G10L 19/008 |
| 2004/0190736 | A1 * | 9/2004 | Gelow | H04R 1/34 381/182 |
| 2006/0254853 | A1 * | 11/2006 | Van Gieson | G10K 11/004 181/191 |
| 2009/0207607 | A1 * | 8/2009 | Haase | H04R 1/028 362/234 |

* cited by examiner

LOUDSPEAKER AND TOWER CONFIGURATION

CROSS-REFERENCE TO RELATED APPLICATION

This application claims priority to U.S. Provisional Application No. 62/740,320 filed on Oct. 2, 2018 and titled LOUDSPEAKER AND TOWER CONFIGURATION, the content of which is expressly incorporated by reference in its entirety.

FIELD

The present disclosure relates to loudspeaker systems and configurations, and more particularly to vehicle loudspeaker systems and configurations.

BACKGROUND

There exists a desire to provide a marine-grade speaker platform with design and functional elements. There also exists a desire for improve directionality and loudspeaker configurations.

BRIEF SUMMARY OF THE EMBODIMENTS

Disclosed and claimed herein are devices and systems for loudspeakers and loudspeaker configurations. In one embodiment, a loudspeaker includes a housing, a mount coupled to the housing, and a coaxial speaker fixed with the housing. The coaxial speaker is fixed with an angular offset from a horizontal plane of the housing.

In one embodiment, the housing is a can housing including a front grill and a back cover.

In one embodiment, the mount includes a clamp configured to mount to a bar, the mount also configured to provide rotational adjustment of the direction of the loudspeaker relative to the mount.

In one embodiment, the coaxial speaker includes at least one of a tweeter driver, mid-range driver and woofer driver configured in a coaxial structure.

In one embodiment, the direction of the coaxial speaker is offset up from a horizontal plane of the loudspeaker housing.

In one embodiment, the housing and mount are configured with salt and spray protection.

In one embodiment, the loudspeaker includes multicolor lighting elements for the housing.

In one embodiment, the loudspeaker includes a connection to receive audio signals and multicolor lighting element control signals Another embodiment is directed to a loudspeaker including a housing, a mount coupled to the housing and at least one multicolor element. The loudspeaker includes a coaxial speaker fixed with the housing, wherein the coaxial speaker is fixed with an angular offset from a horizontal plane of the housing to project sound to position behind a marine vehicle.

In one embodiment, the housing is a can housing including a front grill and a back cover.

In one embodiment, the mount includes a clamp configured to mount to a bar, the mount also configured to provide rotational adjustment of the direction of the loudspeaker relative to the mount.

In one embodiment, the coaxial speaker includes at least one of a tweeter driver, mid-range driver and woofer driver configured in a coaxial structure.

In one embodiment, the direction of the coaxial speaker is offset up from a horizontal plane of the loudspeaker housing.

In one embodiment, the housing and mount are configured with salt and spray protection.

In one embodiment, the loudspeaker includes a connection to receive audio signals and multicolor lighting element control signals.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

One aspect of the disclosure is directed to loudspeaker configurations. In one embodiment, a loudspeaker is provided including a housing, a mount coupled to the housing, and a coaxial speaker fixed with the housing. The loudspeaker may be configured to use with a vehicle and in particular in a pole or tower mount configuration. Exemplary use may include marine applications where speakers are mounted to a pole or tower to direct sound to boat occupants and in a direction to the rear of the boat (e.g., stern) to one or more persons behind the boat (e.g., towed persons, etc.). According to one embodiment, the coaxial speaker may include a fixed an angular offset relative to a horizontal plane of the housing. In that fashion, the speaker may direct sound to a desired position to the rear of vehicle in addition to vehicle occupants. In other embodiments, loudspeaker includes at least one multicolor element. The loudspeaker may be configured to receive audio and color signals from an input to the speaker.

Embodiments are directed to coaxial speaker configurations for marine applications, vehicle applications and tower mount configurations.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

EXEMPLARY EMBODIMENTS

Figure 1A:
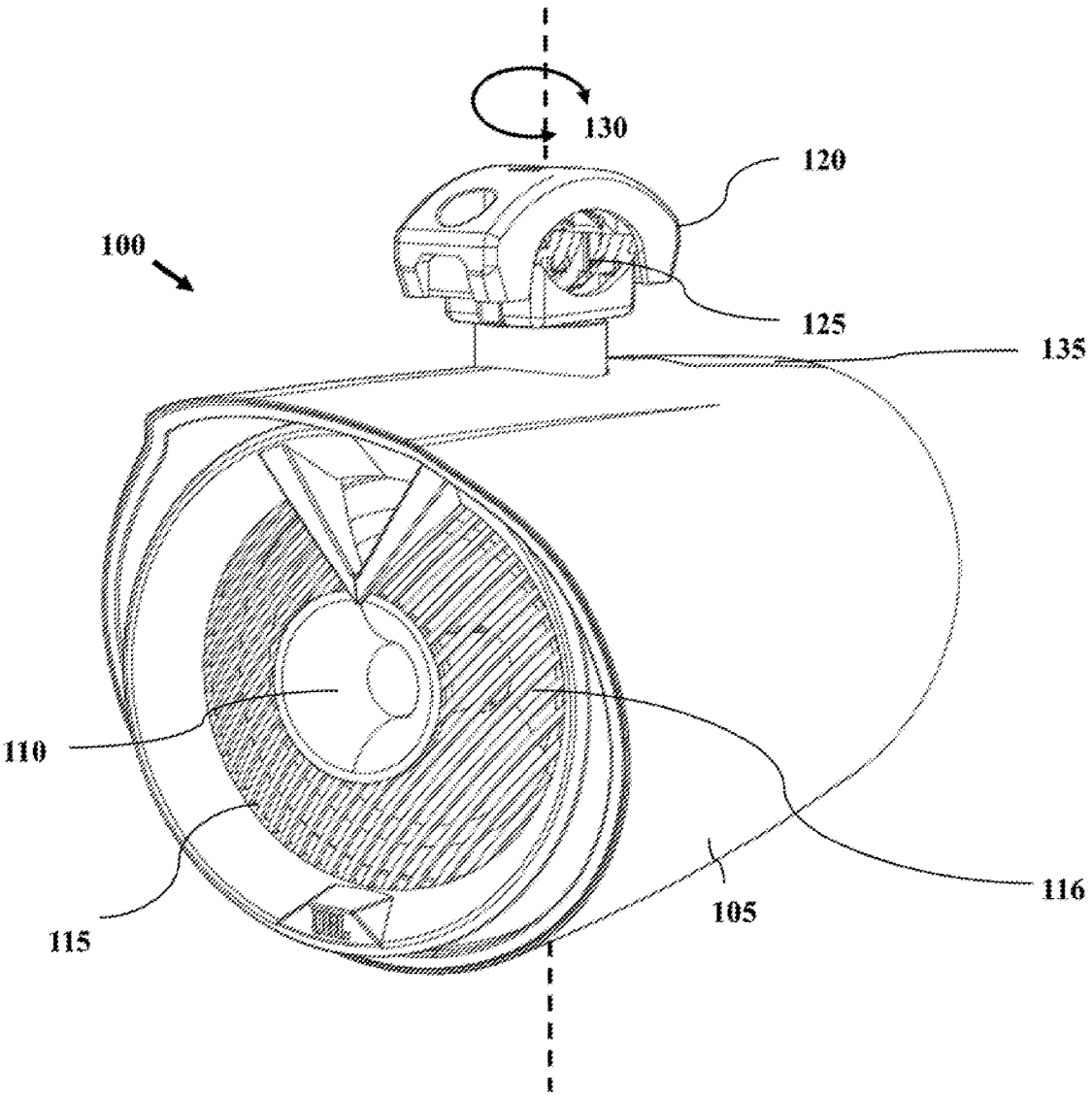
FIGS. 1A-1C depict graphical representations of a loudspeaker according to one or more embodiments.
Figure 1B:
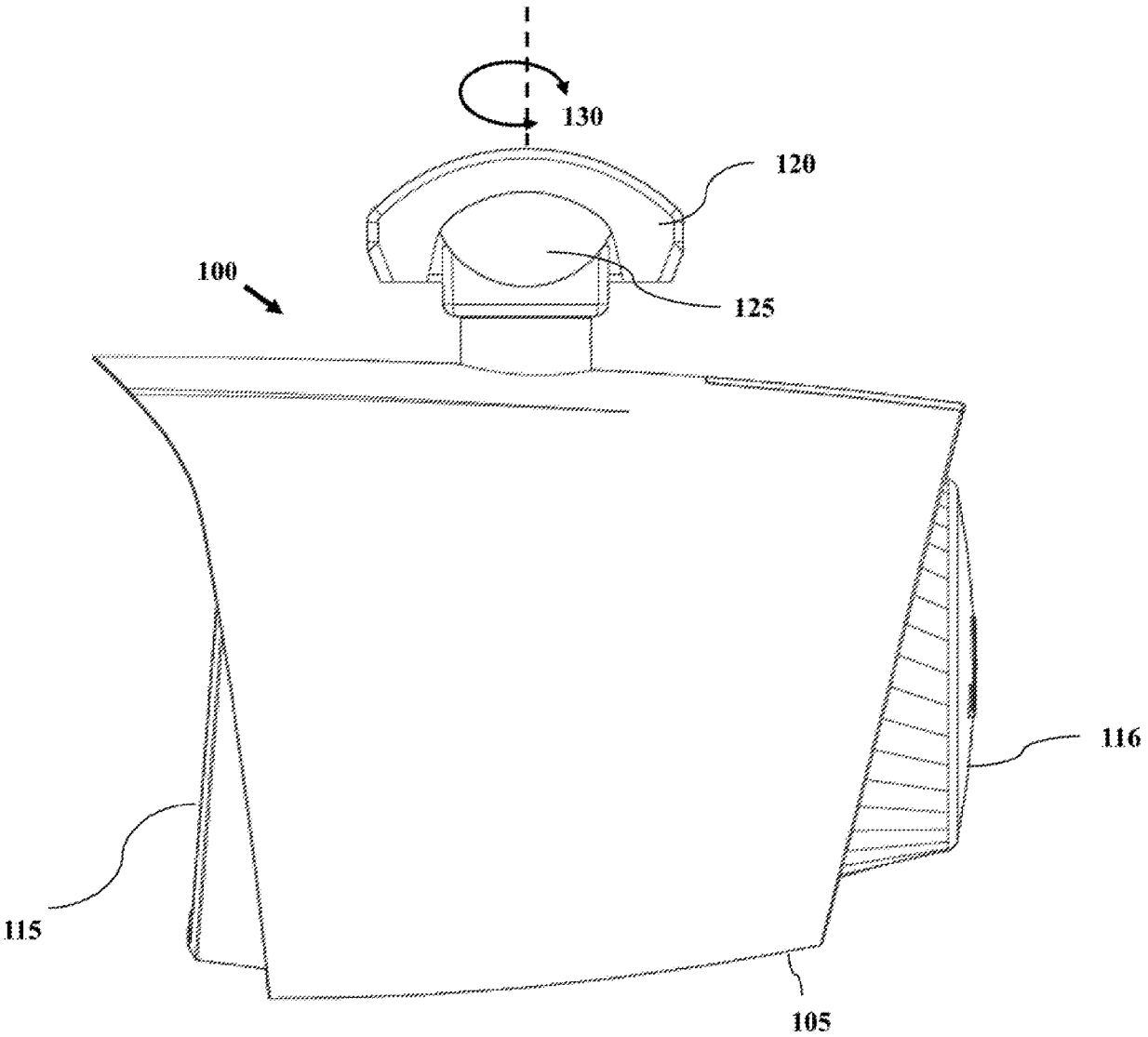
Figure 1C:
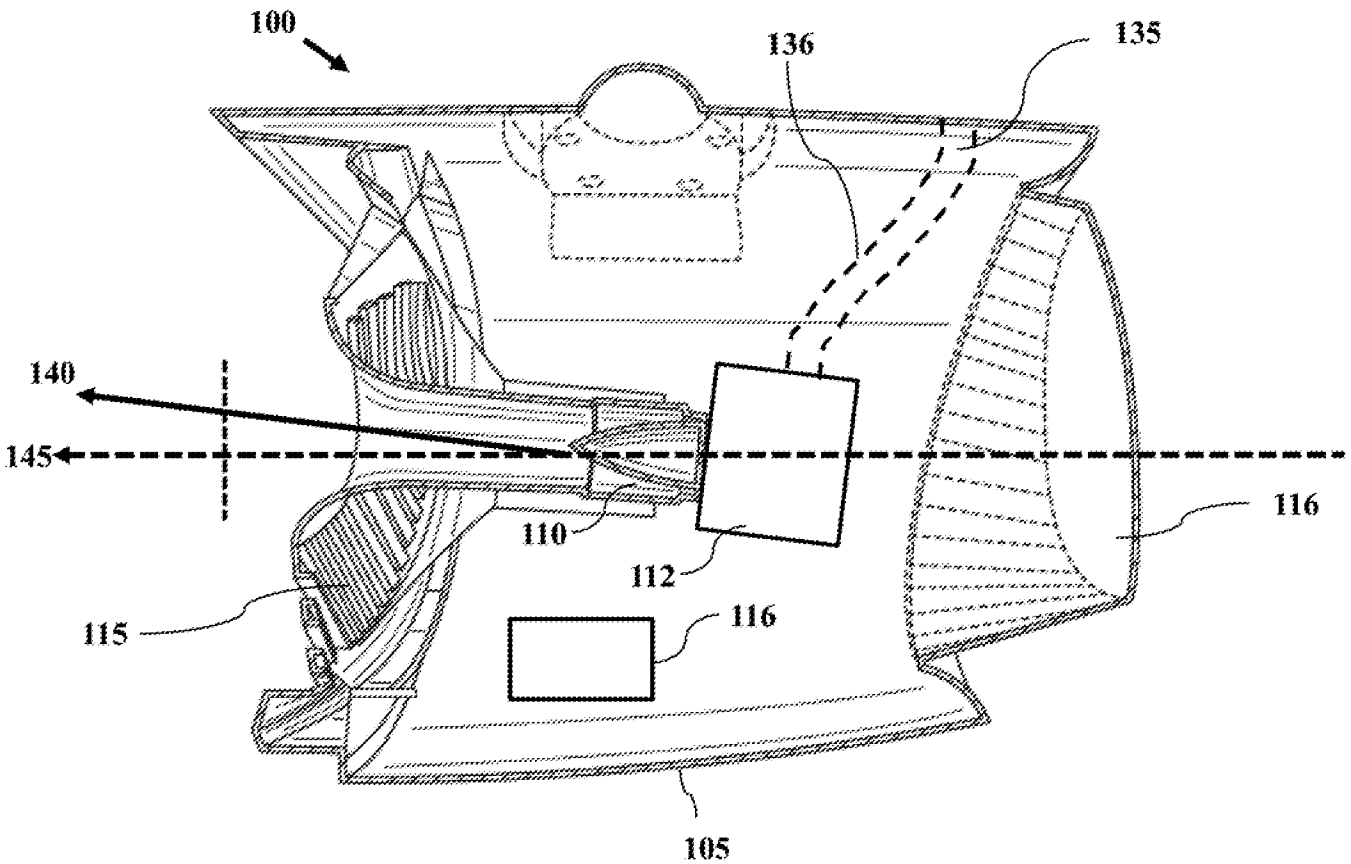

Referring now to the figures, FIGS. 1A-1C depict graphical representations of a loudspeaker. In FIG. 1A, loudspeaker 100 includes housing 105, horn 110, and front grill 115 associated with a coaxial speaker (not shown in FIG. 1A). According to one embodiment, loudspeaker 100 includes a coaxial speaker fixed within housing 105. The coaxial speaker may be fixed with an angular offset from a horizontal plane of the housing 105.

Housing 105 may be a can housing including a front grill 115 and a back cover (not shown in FIG. 1A). According to one embodiment, housing 105 may be configured to be salt and spray resistant. In one embodiment, housing 105 and mount 120 are configured with salt and spray protection. Loudspeaker 110 may be a weather resistant audio product, and suit the demands of outdoor products.

Horn 110 is associated with coaxial speaker of loudspeaker 110. According to one embodiment, loudspeaker 110 is a marine-grade speaker platform with matching cosmetics and industrial design on front face of each product. Loudspeaker 110 may use marine-grade components to withstand a harsh outdoor environment. Loudspeaker 110 may include weather-resistant horn loaded compression driver style speakers. Loudspeaker 110 may provide enhanced performance to overcome wind-noise and other environmental issues present in outdoor applications. Loudspeaker 110 may include a coaxial horn tweeter and a single.

Mount 120 includes opening 125 for pole and/or tower mounting of loudspeaker 110. Mount may be configured to fixedly rotate (e.g., rotate and then be fixed after rotation while allow for adjustment) as shown by direction 130. Mount 120 may allow for rotation in 2 angles axis of rotation. Mount 120 may also provide 360 degrees rotation and a clamp configuration that fits bars of different sizes, (e.g., 1 inch to 4 inches, etc.). In that fashion, mount 120 may be clamp mounted to a bar and provide rotational adjustment of the direction of the loudspeaker relative to the mount 120.

Housing 105 may include connection 135 to receive one or more of audio and lighting control. Connection 135 may receive audio signals and multicolor lighting element control signals According to one embodiment, loudspeaker may include multicolor changing element 116 to illuminate front grill 115 and one or more portions of loudspeaker 100. Multicolor changing element 116 provides a multicolor lighting element for housing 105. Multicolor changing element 116 may provide multi-Color RGB lighting. In one embodiment, multicolor changing element 116 may be mounted to the back of the tweeter flange for complete cone coverage of the flange and to provide a lighting effect. Lighting effects may be provided by a 4-pin connector.

FIG. 1B is a side profile view of loudspeaker 100 according to one or more embodiments. Housing 105 may be a can housing including a front grill 115 and back cover 116.

FIG. 1C is a cross-sectional view of loudspeaker 100 according to one or more embodiments. According to one embodiment, loudspeaker 100 includes coaxial speaker 112. Coaxial speaker 112 may include at least one of a tweeter driver, mid-range driver and woofer driver configured in a coaxial structure. Coaxial speaker 112 may be a two-way coaxial speaker. Coaxial speaker 112 may be fixed with an angular offset 140 from a horizontal plane 145 of housing 105. According to one embodiment, coaxial speaker 112 includes an extended pigtail wire/connection 136 to connection 135 to receive one or more of audio and lighting signals.

According to one embodiment, multicolor changing element 116 provides a multicolor lighting element for front grill 115 of housing 105.

Figure 2:
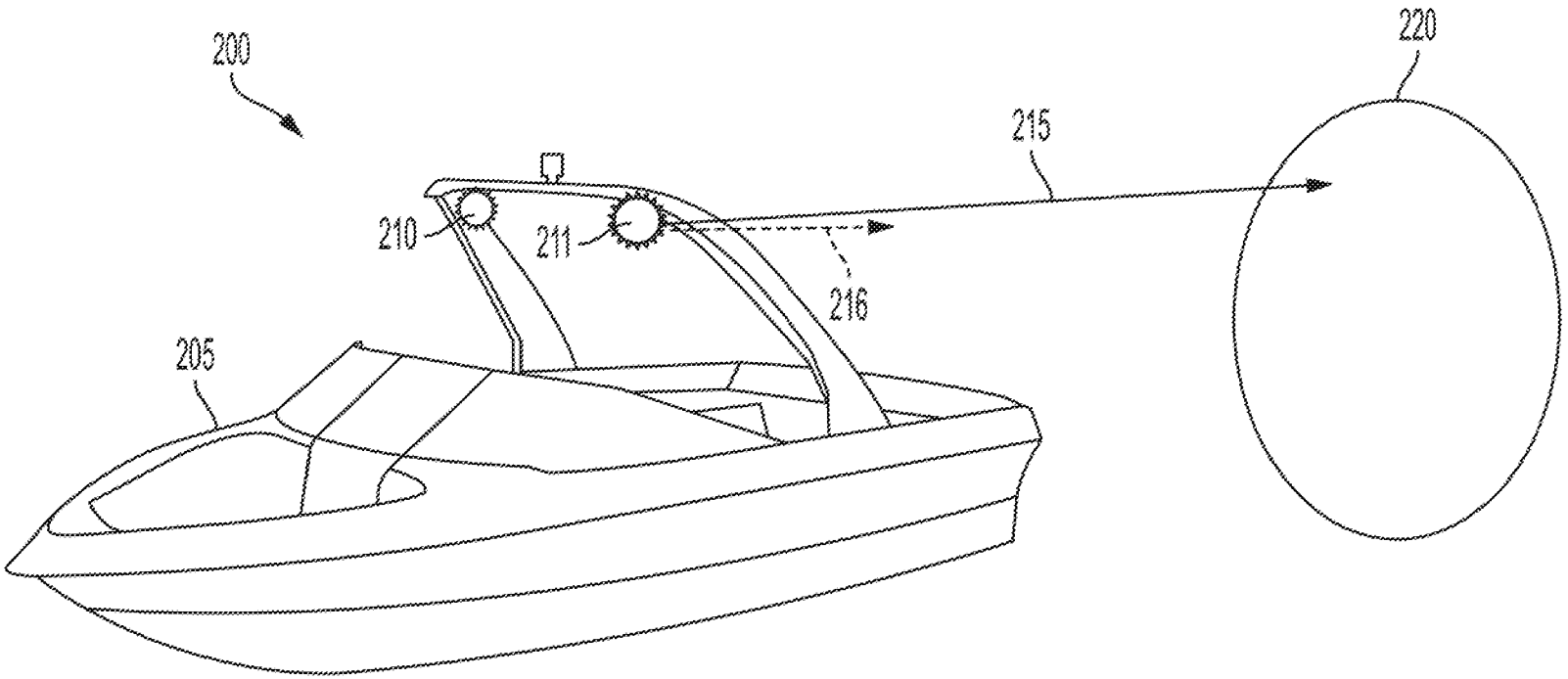
FIG. 2 depicts a graphical representation of a loudspeaker marine application according to one or more embodiments.

FIG. 2 depicts a graphical representation of a loudspeaker marine application according to one or more embodiments. FIG. 2 illustrates a boat 205 including loudspeakers 210 and 211 (e.g., loudspeaker 100). FIG. 2 shows a horizontal plane 215 of the housing of loudspeaker 211 with offset 215 of a coaxial speaker within loudspeaker 211 to direct sound output directed to area 220, which may be associated with a position behind boat 205. Position 220 may be a sweet spot or location of rider associated with boat 205.

Figure 3A:
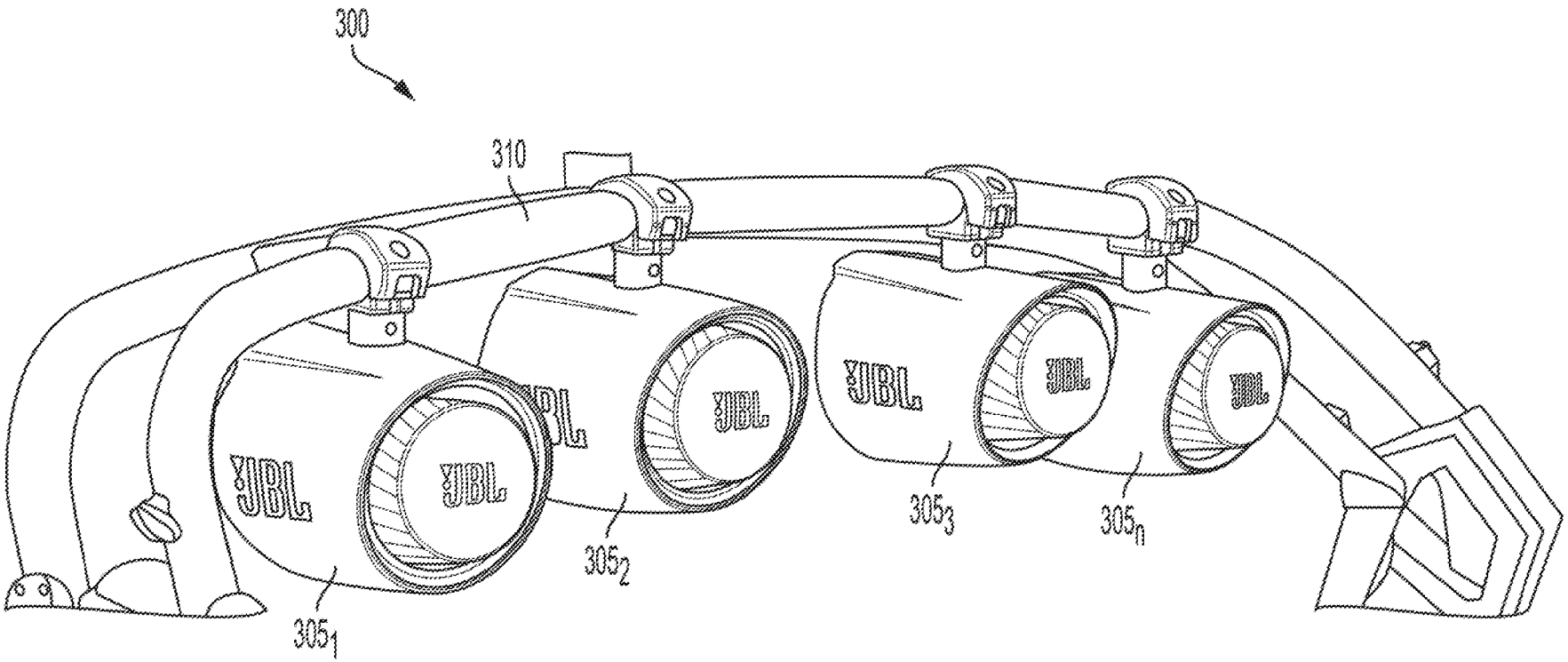
FIGS. 3A-3B depict graphical representations of loudspeaker mounting according to one or more embodiments.
Figure 3B:
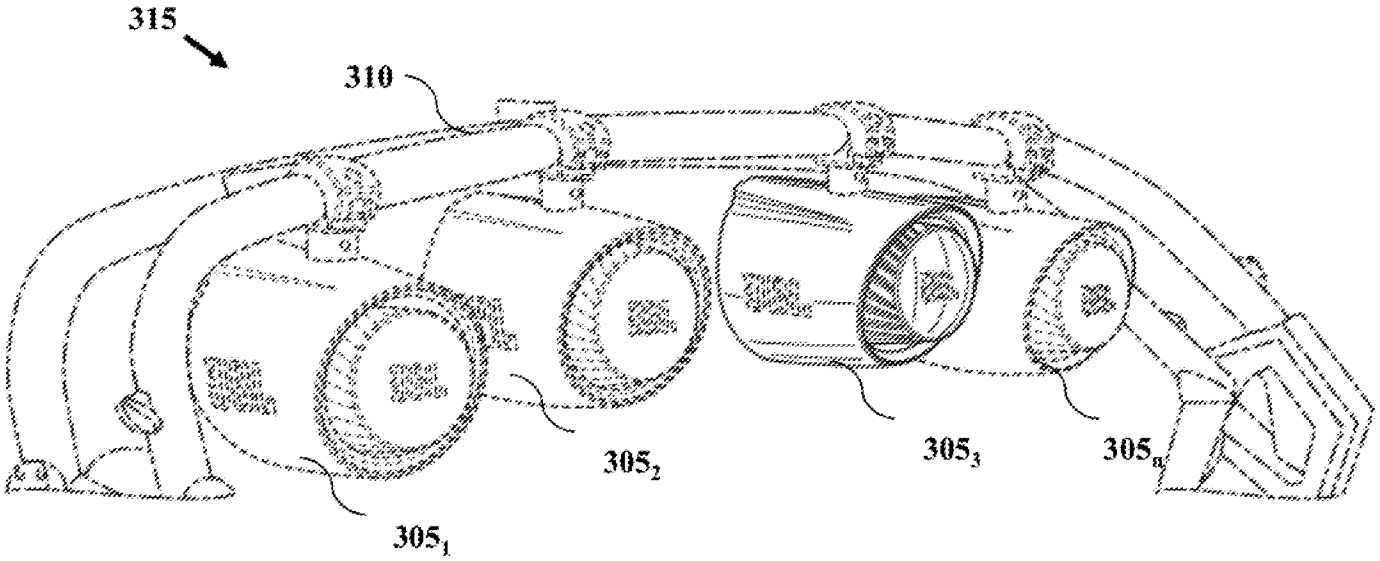

FIGS. 3A-3B depict graphical representations of loudspeaker mounting according to one or more embodiments. FIG. 3A shows an exemplary tower configuration 300 including a plurality of loudspeakers $\mathbf{305}_{1\text{-}n}$ mounted to tower 310. Tower 310 may be a marine tower. Loudspeakers $\mathbf{305}_{1\text{-}n}$ are mounted to face a rear direction. FIG. 3B shows tower configuration 315 including speakers $\mathbf{305}_{1\text{-}n}$ in a mounting arrangement. Tower configuration 315 may include one or more of loudspeakers $\mathbf{305}_{1\text{-}n}$. Tower configurations of FIGS. 3A-3B illustrate a marine configuration, however, the configuration may be applied to other uses including other types of vehicles (e.g., land vehicles, etc.). Tower configurations allow for coaxial speakers fixed within housings loudspeakers $\mathbf{305}_{1\text{-}n}$ to project sound to positions behind a marine vehicle, wherein the coaxial speakers of loudspeakers $\mathbf{305}_{1\text{-}n}$ are fixed with an angular offset from a horizontal plane of housings of loudspeakers $\mathbf{305}_{1\text{-}n}$.

Figure 4A:
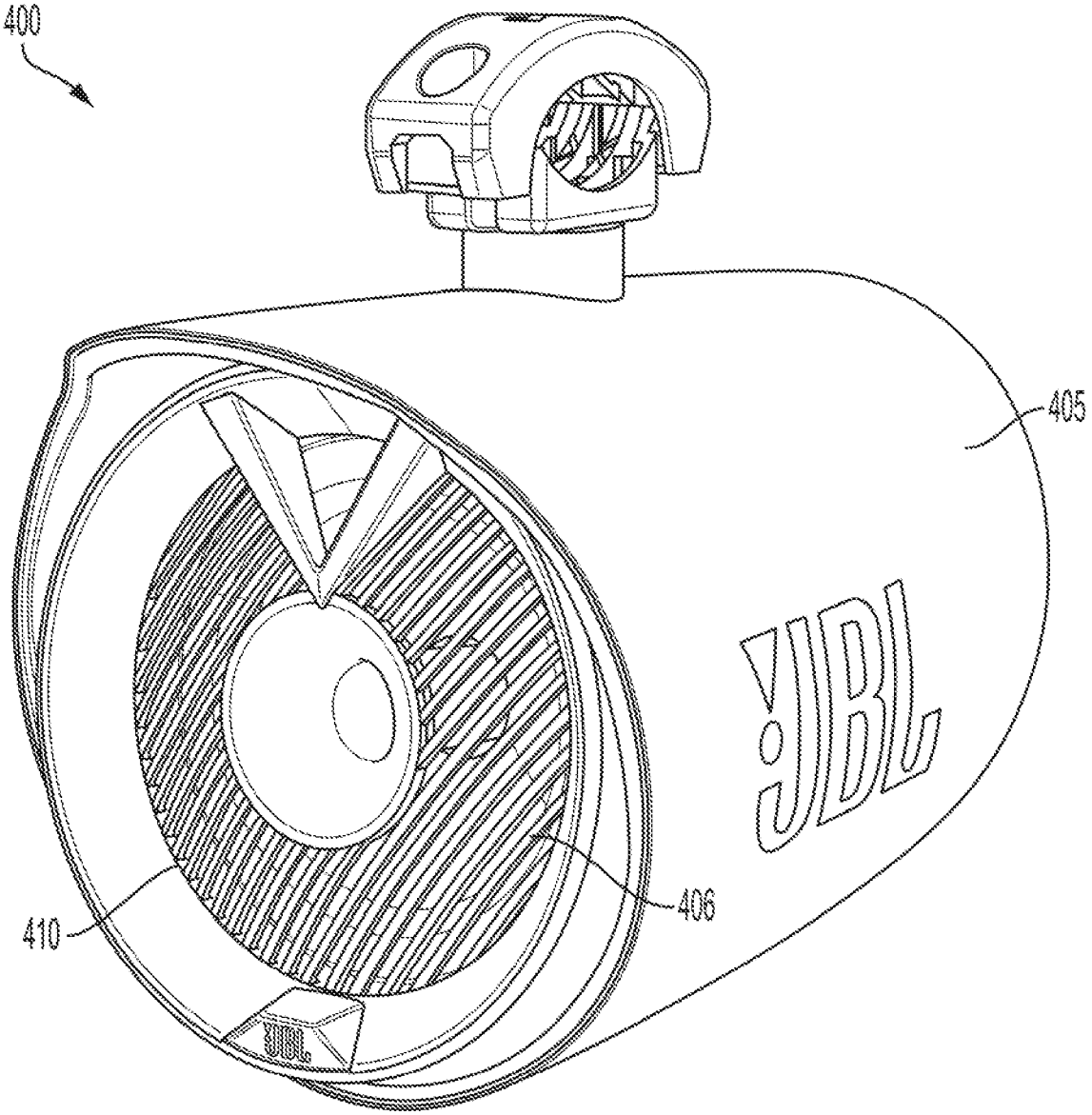
FIGS. 4A-4B depict loudspeaker color projections according to one or more embodiments.
Figure 4B:
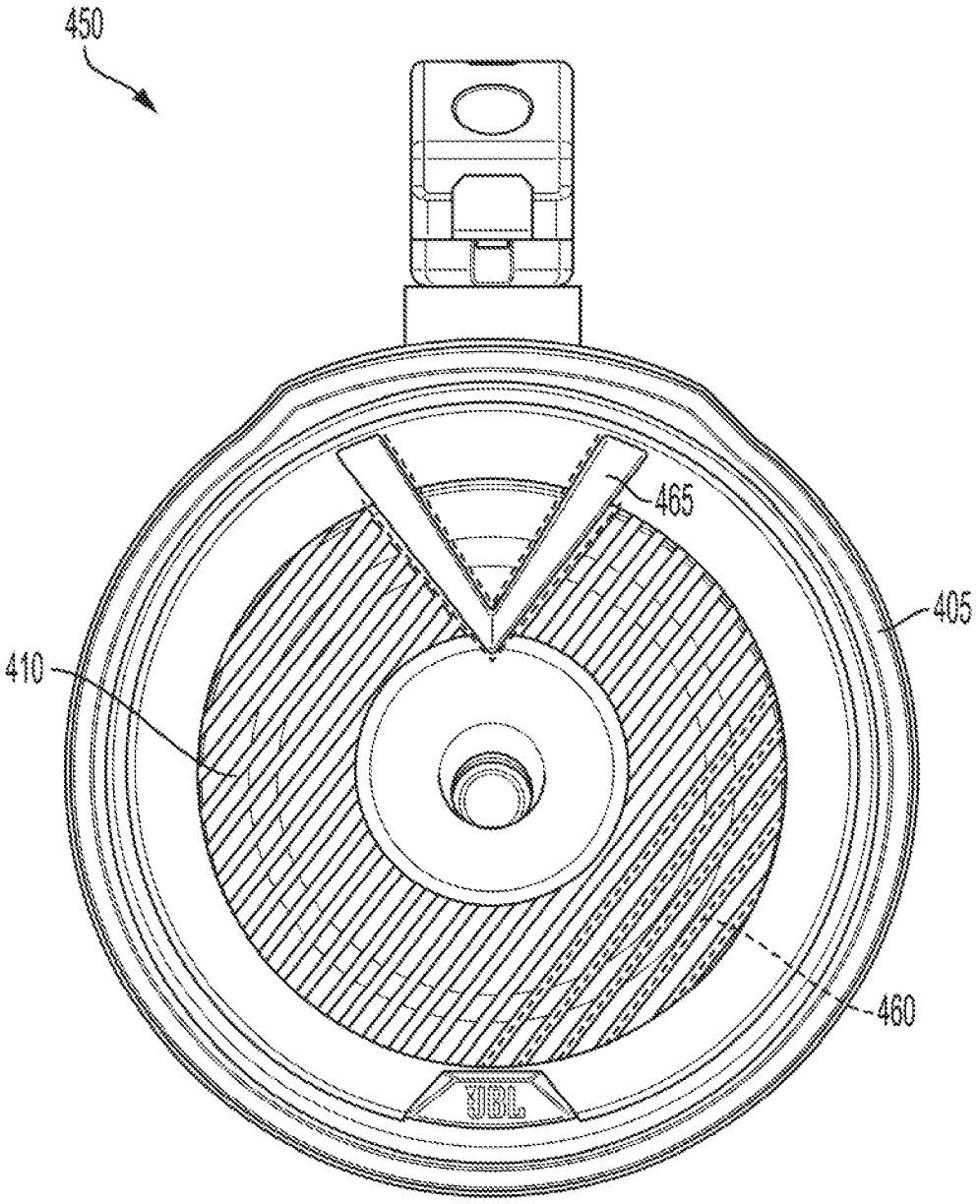

FIGS. 4A-4B depict loudspeaker color projections according to one or more embodiments. According to one embodiment, loudspeaker 400 includes a housing 405 and front grill 410. According to another embodiment, loudspeaker 400 includes at least one multicolor element configured to illuminate at least a portion of loudspeaker 400. According to one embodiment, the multicolor element may be configured to illuminate front grill 410, with color 406. According to one embodiment, color 406 may be associated with one or more colors, color patterns and color changing output.

FIG. 4B shows loudspeaker 450 including housing 405, front grill 410 and illumination with colors 460 and 465. Loudspeaker 450 may include an illumination element configured to illuminate one or more portions of front grill 410 with one or more colors.

While this disclosure has been particularly shown and described with references to exemplary embodiments thereof, it will be understood by those skilled in the art that various changes in form and details may be made therein without departing from the scope of the claimed embodiments.

What is claimed is:

1. A loudspeaker comprising:

a housing with a central cavity extending therein, a central axis of the housing extending through the central cavity;

a front grill of the housing, the front grill including a plurality of slats;

a mount coupled to the housing, the mount rotatable about each of a first axis of rotation and a second axis of rotation; and a coaxial speaker fixedly coupled within the central cavity of the housing, the coaxial speaker comprising a tweeter driver, a mid-range driver, a horn, and a woofer driver arranged in a coaxial structure, and the coaxial speaker fixedly coupled to the housing so that a central axis of the coaxial speaker is offset from the central axis of the housing by a non-zero angle.

2. The loudspeaker configuration of claim 1, wherein the housing is a can housing including the front grill and a back cover.

3. The loudspeaker configuration of claim 1, wherein the mount includes a clamp configured to mount to a bar, the clamp adjustable to mount to at least two bar diameters.

4. The loudspeaker configuration of claim 1, wherein each of the housing and the mount are configured with salt and spray protection.

5. The loudspeaker configuration of claim 1, further comprising a multicolor lighting elements on the housing, the multicolor lighting elements positioned to illuminate the front grill of the housing when the multicolor lighting elements are turned on.

6. The loudspeaker configuration of claim 1, further comprising a connection to receive audio signals and multicolor lighting element control signals from an external controller.

7. The loudspeaker configuration of claim 1, wherein the non-zero angle is selected so that the speaker is directed to a position behind a marine vehicle on which the speaker is mounted.

8. The loudspeaker configuration of claim 7, wherein the non-zero angle is less than 30 degrees.

9. The loudspeaker configuration of claim 1, wherein the horn of the coaxial speaker extends through the front grill, a central axis of the horn collinear with the central axis of the coaxial speaker.

10. The loudspeaker configuration of claim 1, wherein each slat of the plurality of slats is a bar with a rectangular cross section along a curve, a chord of the curve perpendicular to the central axis of the coaxial speaker.

11. A loudspeaker comprising:

a housing with a central cavity extending therein, a central axis of the housing extending through the central cavity;

a mount coupled to the housing, the mount rotatable about a first axis of rotation and a second axis of rotation;

at least one multicolor lighting element; and a coaxial speaker fixedly coupled within the central cavity of the housing, the coaxial speaker comprising a tweeter driver, a mid-range driver, a horn, and a woofer driver arranged in a coaxial structure, and the coaxial speaker fixedly coupled to the housing at an angular offset to project sound to a position behind a marine vehicle.

12. The loudspeaker configuration of claim 11, wherein the housing is a can housing including a front grill and a back cover.

13. The loudspeaker configuration of claim 11, wherein the mount includes a clamp configured to mount to a bar, the clamp adjustable to mount to at least two bar diameters.

14. The loudspeaker configuration of claim 11, wherein the housing and mount are configured with salt and spray protection.

15. The loudspeaker configuration of claim 11, further comprising a connection to receive audio signals and multicolor lighting element control signals from an external controller.

16. The loudspeaker configuration of claim 11, wherein the angular offset is selected so that the central axis of the housing is not parallel with a central axis of the coaxial speaker.

17. The loudspeaker configuration of claim 11, wherein an angle of the central axis of the coaxial speaker relative to the central axis of the housing is selected based on the position behind the marine vehicle, the housing mounted to the marine vehicle.

18. The loudspeaker configuration of claim 11, wherein the multicolor lighting element is positioned to illuminate a front grill of the housing, the front grill of the housing fixedly coupled to the horn of the coaxial speaker.

* * * * *